US006394727B1

(12) United States Patent
Lundberg

(10) Patent No.: US 6,394,727 B1
(45) Date of Patent: May 28, 2002

(54) METHOD OF SECURING BALE WRAPPERS TO BALES AND A FASTENER FOR CARRYING OUT THE METHOD

(75) Inventor: Torgny Jörgen Lundberg, Sundsvall (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/402,192

(22) PCT Filed: Mar. 26, 1998

(86) PCT No.: PCT/SE98/00558

§ 371 (c)(1),
(2), (4) Date: Sep. 30, 1999

(87) PCT Pub. No.: WO98/43877

PCT Pub. Date: Oct. 8, 1998

(30) Foreign Application Priority Data

Apr. 1, 1997 (CH) ..... 9701189

(51) Int. Cl.[7] ..... A43B 23/20; B65D 71/00

(52) U.S. Cl. ..... 411/439; 411/904; 206/83.5; 53/416

(58) Field of Search ..... 411/439, 456, 411/904, 905; 206/388, 83.5, 442; 53/399, 416, 419; 5/409, 665–666, 951, 952

(56) References Cited

U.S. PATENT DOCUMENTS

| | | | | | |
|---|---|---|---|---|---|
| 101,374 | A | * | 3/1870 | Mitchell | |
| 364,301 | A | * | 6/1887 | Rogers | 411/455 |
| 2,208,842 | A | * | 7/1940 | Harvey | 411/456 |
| 3,163,418 | A | * | 12/1964 | Myers | |
| 3,330,409 | A | | 7/1967 | Jorgensen | |
| 3,494,006 | A | * | 2/1970 | Brumlik | 411/456 |
| 3,591,876 | A | * | 7/1971 | Swindlehurst | |
| 3,792,563 | A | | 2/1974 | Mercer et al. | |
| 4,007,950 | A | * | 2/1977 | Giulie | |
| 4,651,507 | A | * | 3/1987 | Koerschener | |
| 5,022,316 | A | * | 6/1991 | Hellwig | |
| 5,079,803 | A | * | 1/1992 | Moore | |
| 5,690,227 | A | * | 11/1997 | Lutz | |

FOREIGN PATENT DOCUMENTS

| | | | |
|---|---|---|---|
| JP | 228074 | * | 8/1995 |
| JP | 183289 | * | 7/1997 |
| JP | 313217 | * | 12/1997 |
| WO | 93/00210 | | 1/1993 |

* cited by examiner

*Primary Examiner*—Flemming Saether
(74) *Attorney, Agent, or Firm*—Lerner, David, Littenberg, Krumholz & Mentlik, LLP

(57) ABSTRACT

Methods are disclosed for securing a wrapper about a bale which is intended to be subsequently treated comprising inserting a fastener pin through the wrapper into the bale, the fastener pin being adapted to remain in the bale during subsequent treatment thereof. Fasteners are also disclosed for securing wrappers about bales.

9 Claims, 2 Drawing Sheets

METHOD OF SECURING BALE WRAPPERS TO BALES AND A FASTENER FOR CARRYING OUT THE METHOD

FIELD OF THE INVENTION

The present invention relates to wrapped bales of the type which, in addition to containing paper pulp, recycled paper or like material also include a casing or wrapper around the bale.

BACKGROUND OF THE INVENTION

The above wrappers must be secured in some manner. These wrappers have normally been secured in place by means of a number of steel wires wrapped around each individual pulp bale. This method is expensive, and complicates the process of transporting the bales from a pulp mill to a paper mill, for instance. The actual cost of the steel wire also represents a material cost that must be met by the pulp manufacturer. It is also necessary to remove the wrapping wires after the bales have arrived at the paper mill, and prior to the bales being fed into a bale shredder. This requires the provision of separate wire cutting equipment and also requires separate handling of the wire scrap that remains.

Several different methods for resolving this problem have been proposed. For instance, U.S. Pat. No. 3,792,563 proposes a solution in which the wrapper is secured to the pulp bales by means of a dissolvable glue which is applied between the mutually overlapping parts of the wrapper. One drawback with this solution, however, is that the glue constitutes a foreign constituent when entire bales are defibered in the paper mill and thereafter delivered to the paper machines as paper stock. Another drawback is that it takes time for the glue to bind, which can result in an unnecessary bottleneck in the packaging line of the pulp mill. Essentially, the same drawbacks are encountered with the method described in PCT Application No. WO 93/00210, in which dissolvable polyvinyl-alcohol tape is wound around the pulp bales. Swedish Patent No. 503,215 teaches a tool for punching and folding-in flaps of overlapping parts of the wrapping sheets so as to fasten these sheets around the pulp bale. This method requires the use of a complicated device for achieving these effects. The device and method are so complex as to tender their use commercially indefensible.

An object of the present invention is to therefore solve the aforesaid problems, and to enable bale wrappings to be secured in a simple and in an environmentally-adapted manner.

SUMMARY OF THE INVENTION

This and other objects have now been realized by the invention of a method of securing a wrapper about a bale intended to be treated comprising inserting at least one fastener pin through the wrapper into the bale, the at least one fastener pin adapted to remain in the bale during the treatment thereof. Preferably, the treatment of the bale comprises dissolving the bale.

In accordance with one embodiment of the method of the present invention, the at least one fastener pin comprises a material adapted to dissolve during the treatment of the bale.

In accordance with another embodiment of the method of the present invention, the at least one fastener pin includes a head for abutment with the outer surface of the wrapper when the at least one pin is inserted through the wrapper, and at least one stem intended to be inserted into the bale.

In accordance with the present invention, these objects have also been realized by the invention of a fastener for securing a wrapper about a bale adapted to be treated comprising a pin including a head for abutment with the outer surface of the wrapper when the pin is inserted into the bale, and at least one stem intended to be inserted into the bale. Preferably, the stem includes removal prevention means for preventing removal of the pin from the bale.

In accordance with one embodiment of the fastener of the present invention, the removal prevention means comprises outwardly facing shoulders. In another embodiment, the removal prevention means comprises outwardly facing hook means.

In accordance with another embodiment of the fastener of the present invention, the pin comprises a material adapted to dissolve during treatment of the bale. Preferably, the material comprises corn starch.

BRIEF DESCRIPTION OF THE DRAWINGS

The present invention will be more fully appreciated with reference to the following detailed description, which in turn refers to the Figures, wherein.

DETAILED DESCRIPTION

Figure 1:
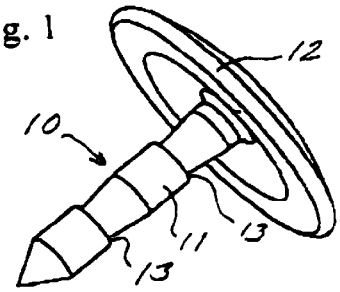
FIG. 1 is a side, perspective view of one embodiment of a fastener device in accordance with the present invention.

FIG. 1 illustrates a first embodiment of an inventive fastener device according to the present invention, the device having the form of a bale wrapping fastening pin. The fastening pin 10 includes a stem 11 and a head 12. The size of the head 12 will be sufficiently large to retain the wrapping by abutment with the outer surface of the wrapping. The stem 11 of the illustrated embodiment includes means which prevent withdrawal of the pin, in the illustrated case these include shoulders 13 which face upwardly towards the head 12. Alternatively, the means may have the form of hooks. The pin 10 is conveniently made of a material that can be dissolved during later treatment of the bale. For instance, the pin may be made of corn starch, or maize starch.

Figure 2:
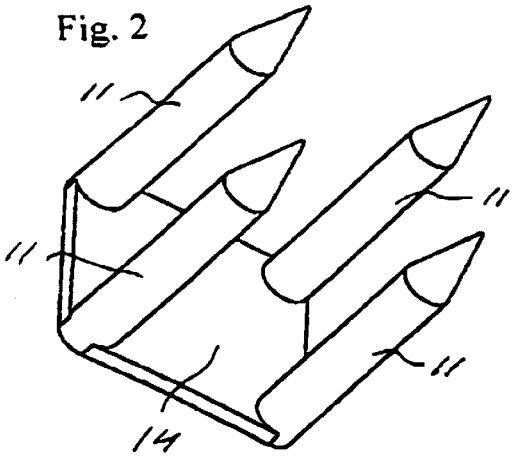
FIG. 2 is a side, perspective view of another embodiment of a fastener device in accordance with the present invention.
Figure 3:
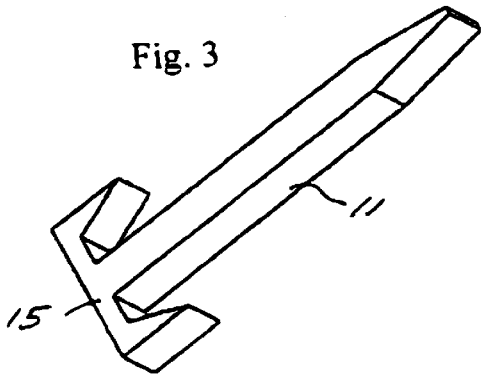
FIG. 3 is a side, perspective view of another embodiment of a fastener device in accordance with the present invention.
Figure 4:
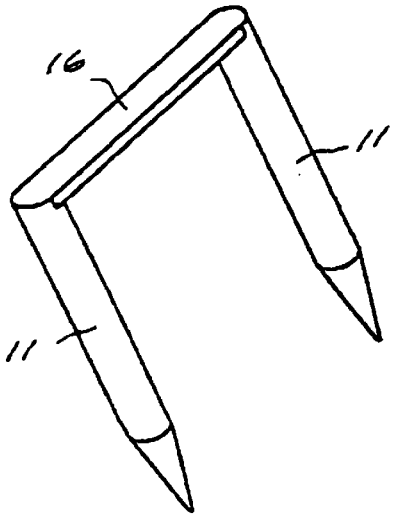
FIG. 4 is a side, perspective view of another embodiment of a fastener device in accordance with the present invention.
Figure 5:
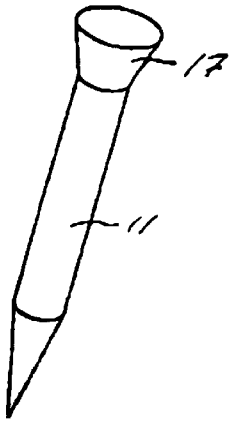
FIG. 5 is a side, perspective view of another embodiment of a fastener device in accordance with the present invention.
Figure 6:
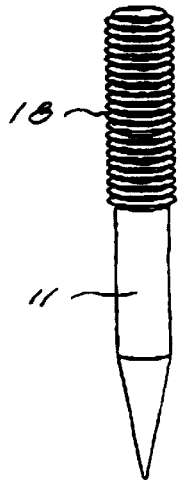
FIG. 6 is a side, perspective view of another embodiment of a fastener device in accordance with the present invention.

FIGS. 2–6 illustrate other embodiments of the inventive fastener device of the present invention. FIG. 2 shows an embodiment that has four stems 11 provided on a plate 14. FIG. 3, shows an embodiment that has a single stem 11 which forms a T-shaped device together with a hooked head 15. FIG. 4 shows an embodiment that has two stems 11 interconnected by a cross member 16. FIG. 5 shows an embodiment in the form of a pin that has a very small head 17. Finally, FIG. 6 shows an embodiment in which the head is replaced with a grooved section 18 at the outer end of the stem 11. It has been found that the necessary technical effect can also be achieved in the absence of an actual head on the pin.

According to the method of the present invention, subsequent to folding the wrapping around the bale, the wrapping is secured in position by pressing the fastener pin 10 into the bale. This can be readily achieved with the aid of a conventional nailing gun, for instance. The fastener pins need not be removed prior to dissolving the bale. The corn starch from which the pins can be made will dissolve at the same time as the bale and is unharmful to the process. The material from which the pin is made and the density of the material can be varied in relation to the ease with which the pins dissolve.

The method and fastener pins according to the present invention afford important advantages in comparison with earlier known technology. The material from which the pins are made is thus environmentally friendly. The pins need not be removed, thereby obviating the need for equipment to remove and handle the fastener devices, as distinct from the case in the prior art method that uses, steel wire. The equipment required for handling and inserting the fastener pins is both simple and inexpensive.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of securing a wrapper about a bale intended to be treated comprising inserting at least one fastener pin through said wrapper into said bale, and dissolving said bale, said at least one fastener pin remaining in said bale during said dissolving thereof.

2. The method of claim 1 wherein said at least one fastener pin comprises a material which dissolves during said treating of said bale.

3. The method of claim 1 wherein said at least one fastener pin includes a head for abutment with the outer surface of said wrapper when said at least one pin is inserted through said wrapper, and at least one stem inserted into said bale.

4. A bale adapted to be treated comprising a wrapper disposed about said bale, and a pin including a head in abutment with said outer surface of said wrapper with said pin inserted through said wrapper into said bale, and at least one stem inserted into said bale, said pin comprising a material adapted to dissolve during treatment of said bale.

5. The bale of claim 4 wherein said stem includes removal prevention means for preventing removal of said pin from said bale.

6. The bale of claim 5 wherein said removal prevention means comprises outwardly facing shoulders.

7. The bale of claim 4 wherein said removal prevention means comprises outwardly facing hook means.

8. The bale of claim 4 wherein said pin comprises corn starch.

9. A method of securing a wrapper about a bale intended to be treated comprising inserting at least one fastener pin through said wrapper into said bale, and treating said bale, said at least one fastener pin remaining in said bale during said treatment thereof and comprising a material which dissolves during said treatment of said bale.

* * * * *

UNITED STATES PATENT AND TRADEMARK OFFICE

CERTIFICATE OF CORRECTION

Figure 7:
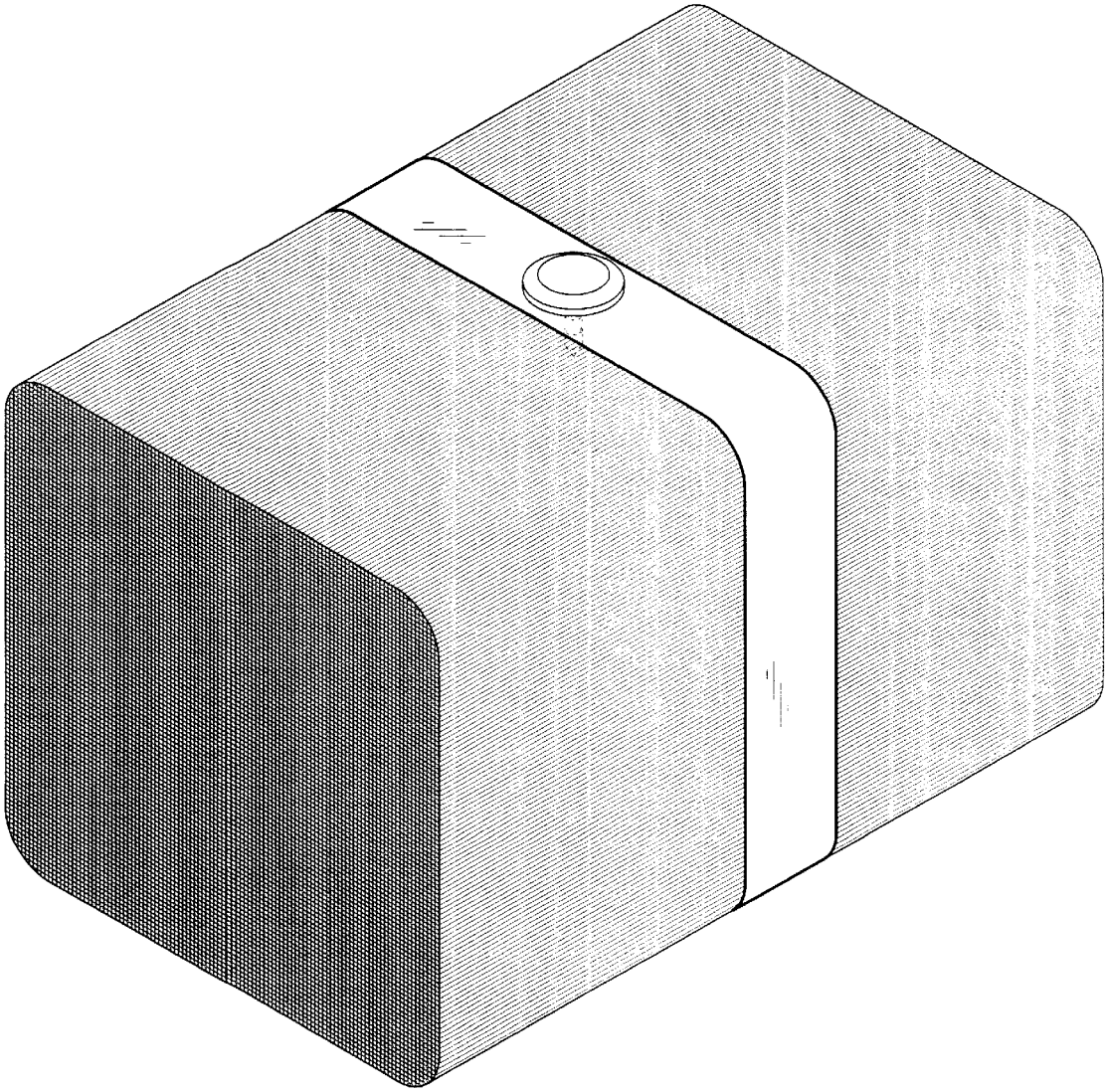
FIG. 7 is a front perspective view of a bale covered by a wrapper including fastener pins extending through the wrapper into the bale in accordance with the present invention.

PATENT NO. : 6,394,727 B1 
DATED : May 28, 2002
INVENTOR(S) : Torgny Jörgen Lundberg It is certified that error appears in the above-identified patent and that said Letters Patent is hereby corrected as shown below:

Drawings,
Delete Figure 7 and the figure on the Title page and insert therefor the following figure.

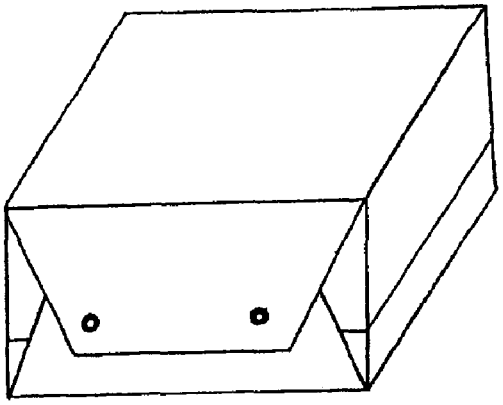

Signed and Sealed this

Twenty-ninth Day of October, 2002

*Attest:*

*Attesting Officer*

JAMES E. ROGAN
*Director of the United States Patent and Trademark Office*